US005295668A

United States Patent [19]

Ohmi et al.

[11] Patent Number: 5,295,668

[45] Date of Patent: Mar. 22, 1994

[54] METAL TUBE OXIDATION TREATMENT APPARATUS

[75] Inventors: Tadahiro Ohmi, Miyagi; Yoshiyuki Nakahara, Osaka; Shigeki Hayashi, Osaka; Takashi Sakanaka, Osaka; Eiji Ohta, Osaka; Fumio Nakahara, Tokyo, all of Japan

[73] Assignee: Osaka Sanso Kogyo Kabushiki-Kaisha, Osaka, Japan

[21] Appl. No.: 842,361

[22] PCT Filed: Sep. 25, 1990

[86] PCT No.: PCT/JP90/01230

§ 371 Date: Apr. 13, 1992

§ 102(e) Date: Apr. 13, 1992

[87] PCT Pub. No.: WO91/05071

PCT Pub. Date: Apr. 18, 1991

[30] Foreign Application Priority Data

Sep. 26, 1989 [JP] Japan ..... 1-249773

[51] Int. Cl.[5] ..... C23C 8/18

[52] U.S. Cl. ..... 266/252; 266/249

[58] Field of Search ..... 266/249, 251, 252; 148/590, 591, 594

[56] References Cited

U.S. PATENT DOCUMENTS 4,032,369 6/1977 Jatczak et al. ..... 148/594

FOREIGN PATENT DOCUMENTS 55-36531 8/1980 Japan .
56-11308 3/1981 Japan .
60-135563 7/1985 Japan .

*Primary Examiner*—Scott Kastler
*Attorney, Agent, or Firm*—Baker & Daniels

[57] ABSTRACT

It is a metal oxidation treatment apparatus for carrying out the inactivation treatment of metal tubes used especially in a super high purity gas piping system and an apparatus of super high vacuum.

The support part of a support member is made as a tubular form member, and a tapered part is provided on the outer periphery thereof, and further, since a spring is mounted to be displaceable, even if fluctuation is present in the internal diameter of stainless steel tubes, it is possible to let the stainless tubes easily be supported on the support part. Also, even fluctuation of the length is present in the stainless steel tubes, the support member is always pushed to the stainless steel tubes. Oxidative gas diffusing out of the tube to be treated to the outside thereof can be released to the outside of the oxidation treatment furnace without letting it contact to the tube to be treated.

10 Claims, 7 Drawing Sheets

METAL TUBE OXIDATION TREATMENT APPARATUS

BACKGROUND OF THE INVENTION

The present invention relates to a metal tube oxidation treatment apparatus, and relates particularly to a metal tube oxidation treatment apparatus for carrying out the inactivation treatment of the metal tube used in a super high purity gas piping system and a super high vacuum apparatus.

In recent years, the technology for realizing super high vacuum, or the technology for producing a reduced pressure atmosphere of super high purity by making a small flow amount of a predetermined gas flow into a vacuum chamber has become very important. These technologies are widely used in the research of material characteristics, the formation of various kinds of thin films, the production of semiconductor devices, etc., and as a result, although more and more high vacuum degree has been realized, but it is very strongly desired further to realize a reduced pressure atmosphere in which the mixing of impurity elements and impurity molecules has been reduced to the extreme limit.

For example, when it is exemplified with the case of the semiconductor device, the dimension of unit elements has become smaller year by year in order to improve the assembling degree of the integrated circuit, and research and development are actively carried out in order to practically obtain the semiconductor devices having the dimension of 1 μm to submicron, and further, less than 0.5 μm.

The production of such a semiconductor device as described above is carried out by repeating the procedure for forming thin films, the procedure for etching the formed thin films to a predetermined circuit pattern, etc. Then, in the process such as described above, it is usual to carry out the procedure in a super high vacuum state or in a reduced pressure atmosphere in which a predetermined gas has been introduced by putting the silicon wafers in general in a vacuum chamber. If impurities are mixed in these procedures, there are generated problems such as, for example, the film quality of thin films is deteriorated, and the accuracy of the fine finishing can not be obtained. This is the reason why the super high vacuum and the reduced pressure atmosphere of super high purity are requested.

As one of the greatest causes which prevented the realization of the super high vacuum and the reduced pressure atmosphere of super high purity, can be cited the gas released from the surface of the stainless steel and the like which are widely used in the chamber and gas pipings. Especially, it was the greatest pollution source that the water adsorbed on the surface was separated out in vacuum or in the reduced pressure atmosphere.

FIG. 6 is a graph for showing the relationship between the total leak amount of the system added with the gas piping system and reaction chambers in various kinds of apparatus (the sum of the released gas amount from the piping system and the reaction chamber internal surface and the external part leak) and the pollution of the gas. By the way, it is assumed that the original gas does not perfectly contain impurities. Plural number of lines in the figure show the result of the cases in which the flow amount has been changed to various values by making it as a parameter. Although it is a matter of course, that the less the gas flow amount becomes, the more the effect of the released gas from the internal surface is revealed, and the impurity concentration becomes relatively high.

The semiconductor process has such a tendency as to decrease the flow amount of the gas more and more in order to realize the procedures of higher accuracy such as the hole opening, the hole burying, etc. of high aspect ratio, and for example, it is usual, for example, in the process of submicron ULSI to use the flow amount of several ten cc/min or the less. When it is assumed that the flow amount of 10 cc/min is tentatively used, there is the system total leak about $10^{-3}$ to $10^{-6}$ Torr·l/sec in such a manner as in the apparatus widely used at present, the purity of the gas becomes 1% to 10 ppm, and it becomes far from the one of the high purity process.

The present inventor has invented the supply system of super high purity as, and has succeeded to check the leak amount from the external part of the system to less than $1\times10^{-11}$ Torr·l/sec which is the detection limit of the detector at present. However, due to the leak from the inside of the system, that is, due to the constituents of the released gas from the surface of the above-described stainless steel, it was unable to reduce the impurity concentration of the reduced pressure atmosphere. The minimum value of the surface released gas amount obtained by the surface treatment in the super high vacuum technology at present, is in the case of the stainless steel is $1\times10^{-11}$ Torr·l/(sec·cm$^2$), and even it is assumed that the surface area exposed in the inside of the chamber has been estimated to be smallest such as, for example, 1 m$^2$, the leak amount becomes in total as $1\times10^{-7}$ Torr·l/sec, and the gas of the purity of about 1 ppm can be obtained for the gas flow amount of 10 cc/min. It is needless to say that the purity decreases further, when the gas flow amount has been diminished further.

In order to decrease the degassed constituent from the internal surface of the chamber to about the same degree as $1\times10^{-11}$ Torr·l/sec which is equal to that of the external leak amount of the total system, it is necessary to make the degassing from the surface of the stainless steel be less than $1\times10^{-15}$ Torr·l/sec cm$^2$, and for that purpose, the treatment technology of the surface of the stainless steel for decreasing the gas release amount was strongly requested.

Also, in the semiconductor production process, various kinds of gases such as from the comparatively stable general gases ($O_2$, $N^2$, Ar, $H^2$, He) to the special gases having strong reactivity, corrosive properties, and toxicity are used. In general, as the material of the piping and chamber for treating these gas, stainless steel is used in many cases from the reasons such as the reactivity, anti-corrosiveness, high strength, the easiness of the secondary processability, the easiness of the welding, and the easiness of polishing the internal surface.

Stainless steel is excellent in the anti-corrosiveness in a dry gas atmosphere. However, in special gases, there are such ones as boron trichloride ($BCl_3$), boron trifluoride ($BF_3$), which show strong corrosiveness by forming hydrogenchloride and fluoric acid when water is present in the atmosphere, and in the case when water is present in the gas atmosphere of the chlorine system and fluorine system such as the above-described $BCl_3$ and $BF_3$, stainless steel is easily corroded. Therefore, after the surface polishing of the stainless steel, the anti-corrosiveness treatment becomes indispensable.

As the treatment method for the anti-corrosiveness, there are the Ni-W-P coating and the like method (clean escorting method) which covers stainless steel with a metal having strong anti-corrosiveness, but in these methods, not only cracks and pin holes are liable to be formed, but also there are problems such as that the adsorption amount of water on the internal surface and the residual constituents of the solution become much, since they are the method of using the wet type galvanization. As another method, can be cited the anti-corrosiveness treatment in which a thin oxide film is formed on the metal surface by the inactivation treatment. Since stainless steel is inactivated by only being immersed in a liquid, when there is present a sufficient oxidizer in the liquid, the inactivation treatment is carried out in general at ordinary temperature or in a state where the temperature is somewhat raised in immersing in a nitric acid solution. However, since this method is also a wet method, much water and residual component of the treating solution are present in the piping and on the internal surface of the chamber. In the abovedescribed methods, the presence of adsorbed water on the internal surface gives severe damage to the stainless steel in the case when the chlorine system and fluorine system gases were made flown thereon.

Therefore, it is very important in the super high vacuum technology and the semiconductor process to constitute the chamber and the gas supply system with stainless steel formed with an inactive state film which is not subjected to damage even for a corrosive gas and has little absorption and adsorption of water.

For example, in the inactivation treatment of the stainless steel pipe, when the heat oxidation treatment has been carried out in a high purity atmosphere in which the content of water is less than 10 ppb, an inactive state film excellent in the degassing characteristics can be obtained.

FIG. 7 shows the change of the water amount contained in the purge gas in the case when stainless steel pipes having different internal surface treatment have been purged at ordinary temperature. In the experiment, $N_2$ gas was flown in a ⅜" stainless steel pipe of the total length of 4 m at the flow amount of 450 ccm, and the water amount contained in the $N_2$ gas at the outlet was measured by use of the HYCOSMO (low temperature optical dew point measuring instrument).

In FIG. 7, (a) shows the result of the test on the stainless steel pipe having been electrolytically polished on the internal surface.

The test shown in FIG. 7 has been carried out after the sample has been left for about 1 week in a clean room of the relative humidity of 50% and the temperature of 23° C.

As is clearly known in (a) of the FIG. 7, it is known that, in the electrolytically polished pipe, a large amount of water is detected. After passing the gas for about 1 hour, about 100 ppb of water is also detected, and even after 2 hours, the water amount is detected for about 50 ppb, and it is known that the water amount is not quite decreased.

On the contrary, it was elucidated by the present inventor that the process has extremely excellent degassing characteristics in the case when the inactivated state film has been formed in a high purity dry atmosphere.

However, it is necessary to make the water content be less than 10 ppb in order to produce a stainless steel pipe having the extremely excellent degassing characteristics of the adsorbed gas, and in order to realize the super high purity oxidation atmosphere, the condition control of a high degree is necessary, and the process has high cost and its production efficiency is bad, so that the process could not be said as to be suitable to mass production. That is, by use of the conventional generally used metal oxidation treatment apparatus and the metal oxidation treatment method, it was unable to realize the oxidation atmosphere of such a super high purity as described above.

Also, especially in the stainless steel pipes having small internal diameter of such as ¼", ⅜" and ½", the oxidation treatment has been carried out in such a state as it is that the inside of the stainless steel pipe has been exposed to the ambient air atmosphere and has been polluted. Also, since the external side of the stainless steel pipe has in general no relationship to the characteristics, it is very much polluted in comparison to the internal surface. When there is such a case that the gas contacting to this external surface is mixed to the gas for treating the internal surface, it is very difficult to keep the super high purity degree of the gas for treating the internal surface, and an inactivated film of good quality which is excellent in the corrosiveness and having little occlusion and adsorption of water can not be formed. Also, in the external side of the stainless steel pipe, the surface after the oxidation treatment becomes dirty by the roughness and dirtiness of the surface. Due to the fact that the external side of this stainless steel pipe oxidized becomes the cause of problems such that the pipe looks dirty and particles are generated in the case when it was piped in a clean room, together with that an inactivated state film of good quality can not be formed on the internal surface.

Therefore, in the mass production technology of the inactivation treatment of the metals to be oxidized such as the stainless steel pipe and the like, it was desired to establish the technology in which the external surface is not oxidized, together with that an inactive state film having excellent anti-corrosiveness and little occlusion and adsorption of water is formed.

Therefore, the apparatus shown otherwise in FIG. 8 has been proposed as such a technology (Japanese Patent Application No. 195185/1988).

In the apparatus shown in FIG. 8, a groove 134 having the diameter of approximately the same as the external diameter of the stainless steel pipe 101 is formed on the one surface, and the introducing port 135 and exhausting port 136 of the gas are formed on the another surface, and further, a pair of holders 103 and 104 which has communicated the groove 134 to the introducing port 135 and the exhausting port 136 is used, and further, the apparatus has such a structure that an inactive gas is introduced into the oxidation treatment furnace 137 from 119 and can be exhausted from 121.

The stainless steel pipe 101 is inserted into the groove 134 at the end thereof, and are held on the holders 103 and 104. Also, in another surfaces of the holders the gas introducing pipe 107 and the gas exhausting pipe 109 are connected.

That is, as the maximum feature of this technology, in the oxidation treatment furnace 137, while the gas is introduced form one end of the stainless steel pipe 101, ad the gas is always exhausted from another end, and impurities of the water separated from the internal surface of the stainless steel pipe 101 as the metal to be oxidation treated is exhausted out of the oxidation treatment furnace 137, and the stainless steel pipe 101 can be heat oxidized in a dry oxidation treatment atmosphere. Thereby, the water concentration in the oxidation treatment atmosphere can be decreased to less than the value objected (for example, less than 10 ppb in the case of the stainless steel), and the formation of a good inactivated state film on the surface of the metal to be oxidation treated is enabled.

Also, even if it is a stainless steel pipe in which the gas is difficultly flown, such as the stainless steel pipe and the like having small internal diameter, since the inlet and the outlet of the gas are arranged in such a manner that both ends of the stainless steel pipes are contacted, it becomes possible that the oxidation treatment atmosphere gas is flown in the inside of the stainless steel pipe, and the metal processed is heat oxidized in a dry oxidation treatment atmosphere. Thereby, the water concentration in the oxidation treatment atmosphere can be reduced to less than the objected value (for example., less than 10 ppb), and the formation of good inactivated state film on the surface of the metal processed becomes possible.

However, it was understood that the following problems are generated in this technology.

(1) At first, it is difficult to insert the stainless steel pipe 101 in the groove 134 of the holders 103 and 104. That is, when the internal diameter of the groove 134 is made too larger than the external diameter of the stainless steel pipe 101, there is generated a gap between the groove 134 and the stainless steel pipe 101, and the oxidative gas flows into the oxidation treatment furnace 137, and together with that an activated state film of good quality can not be formed on the internal surface of the stainless steel pipe 101, the external surface is also oxidized, and in order to prevent such a phenomenon, it is necessary that the internal diameter of the groove 134 is made approximately the same with the external diameter of the stainless steel pipe 101. However, when the internal diameter of the groove 134 and the external diameter of the stainless steel pipe 101 are made approximately be in the same size, the insertion of the stainless steel pipe in the groove 134 becomes difficult.

Especially, in the case when the stainless steel 101 has long length or has a small diameter, the difficulty is further increased.

Also, it is also difficult to finish the internal diameter of the groove 134 with good accuracy such that it is approximately the same with the internal diameter of the stainless steel pipe 101.

(2) Secondly, even if the finishing of the groove could be finished with good accuracy, in the case when fluctuation is present in the external diameter of the stainless steel pipes, the insertion into the groove 134 becomes impossible, when the external diameter is large, and on the contrary, when the external diameter is small, a gap is generated as has been described above, and together with that an inactivated state film of good quality can not be formed on the stainless steel pipe 101, external surface burning is generated on the external surface. By the way, such an external burning is liable to be generated at the end part of the stainless steel pipe 101.

(3) Since the gap between the holders 103 and 104 of the stainless steel pipe is constant, in the case when fluctuation was present in the length of the stainless steel pipe, then, as shown in FIG. 9, gap is generated between the groove 134 and the stainless steel pipe 101*s* in the case of a short stainless steel tube 101*s*, and an oxidative gas flows into the oxidation treatment furnace 137 from the gap thereof, and together with that inactivated state film of good quality can not be formed on the internal surface as described in (1) and (2), and there is generated the external surface burning.

(4) When the elongation by thermal expansion is generated in the stainless steel pipe 101 at the time of heating, deformation is generated in the pipe processed, since its both ends are restricted. When play is made to be present in order to prevent the deformation, the oxidative gas flows into the space of the oxidation treatment furnace from the inlet as described in (3), and together with that an inactivated state film of good quality can not be formed on the internal surface of the stainless steel pipe, but also the external surface is oxidized.

(5) In the case when the stainless steel pipe is a long length pipe, bending due to the weight of itself is generated at the central part.

By the way, the above-described problems were found out by the present inventor, and the present invention has been carried out on the basis of the discovery of such problems.

SUMMARY OF THE INVENTION

The metal pipe oxidation treatment apparatus of the present invention comprises an oxidation treatment furnace having an inert gas inlet for introducing inert gas into the inside and an inert gas outlet for outletting the inert gas to outside; the first hollow member for supporting the pipe processed at one end thereof in said oxidation treatment furnace, and together with that, for introducing the gas from the outside of said oxidation treatment furnace uniformly into respective stainless steel pipes 101 in said pipes to be processed; and the second hollow member for outletting the gas to the outside of the oxidation treatment furnace from the pipe processed, together with that for supporting the pipe processed at another end thereof in said oxidation treatment furnace, and is characterized by that the supporting part of the pipe processed in said first hollow member and said second hollow member is made in tubular form, and on the outer periphery of said tubular member, a tapered portion with outer diameter gradually decreasing toward the tip is formed, and further, a spring is mounted at a suitable position of said second hollow member in such a manner that said second hollow member can displace to the long length direction of the pipe processed.

Also, it comprises an oxidation treatment furnace having an inert gas inlet for introducing inert gas into inside, an inert gas outlet for outputting the inert gas to outside; the first hollow member for introducing the gas from the outside of said oxidation treatment furnace uniformly into respective stainless steel pipe 101 in the pipes processed, together with that the pipe processed is supported at one end thereof in said oxidation treatment furnace; and the second hollow member for outletting the gas from the pipe processed to outside of the oxidation treatment furnace, together with that the pipe processed is supported at another end thereof in said oxidation treatment furnace, and is characterized by that the supporting part of the pipe processed in said first hollow member and said second hollow member is made in a tubular form, and a taper in which the external diameter gradually decreases is formed on the external circumference of said tubular body, and a covering pipe is provided in the external side of the tubular body of said first hollow member in such a manner as to cover said tubular body, and the space formed between said tubular body and said covering pipe is made to communicate to the outside of said oxidation treatment furnace.

Further, it comprises an oxidation treatment furnace having an inert gas inlet for introducing inert gas into inside, and an inert gas outlet for exhausting inert gas to the outside; the first hollow support member for introducing the gas from the outside of said oxidation treatment furnace uniformly into respective stainless steel pipes 101 to be processed, together with that the pipe processed is supported at one end thereof in said oxidation treatment furnace; and the second hollow support member for outletting the gas from the pipe processed to the outside of the oxidation treatment furnace, together with that the pipe processed is supported at another end thereof.

The supporting part of the pipe processed in said first hollow member and said second hollow member is made in a tubular form, and on the outer periphery of said tubular member, a tapered portion with outer diameter gradually deceasing toward the tip is formed, and further, at least one hole has been provided in the vicinity of the terminal part of said tubular body of said second hollow supporting member.

In the present invention, the supporting part of the supporting member is made in a tubular form, and a tapered part is provided on the outer periphery thereof, and further, since a spring is mounted to be displaceable, it is possible to support the stainless steel pipe on the supporting part easily. Also, even if there is fluctuation in the length of the stainless steel pipe, no gap is generated between the supporting member and the stainless steel pipe, since the supporting member is always pushed to the stainless steel pipe, and an inactivated state film of good quality can be formed on the internal surface, and together with that, the external surface burning is prevented. Also, the "gasket" which becomes an article of expenditure is not used and the re-finishing and re-cleaning of the pipe terminal is not necessary, and the cost down and the improvement of the productivity become simultaneously attained.

In the present invention, a cover tube is provided in such a manner as that it covers the tubular member of the first supporting member, and moreover, since the space formed by the tubular member and the cover tube is made communicated to the outside of the oxidation treatment furnace, even if oxidative gas is diffused from the pipe processed to the outside of the oxidation treatment furnace, this oxidative gas does not contact the pipe processed and is released to outside, and the external surface burning in the vicinity of the first support member of the pipe processed can be prevented.

In the present invention, since a hole is provided in the vicinity of the end part of the tubular member of the second support member, even if an oxidative gas is diffused from the pipe processed to the outside of the pipe processed, since this oxidative gas is exhausted to the outside of the oxidation treatment furnace, the external surface burning in the vicinity of the second support member of the pipe processed can be prevented.

BRIEF DESCRIPTION OF THE DRAWINGS

FIGS. 1 to 5 relate to an embodiment of the present invention, wherein FIG. 1 is a partial side sectional view of the apparatus; FIG. 2 is an enlarged view of the support member; FIG. 3 is a front view of the sword guard form member; FIG. 4 is a side view for showing the receiving step; FIG. 5 is a gas supply system circuit diagram.

DETAILED DESCRIPTION OF THE INVENTION

The following reference numbers are used herein: 101 metal tube to be oxidation treated (stainless steel tube),
101*s* stainless steel tube,
102 oxidation furnace chamber.
103 first support member (first holder),
104 second support member (second holder),
107 gas introducing line, 108 gas line,
109 gas exhausting line,
110*a*, 110*b* exhaust line, 111*a*, 111*b* flow meter,
114*a*, 114*b*,114*c*,114*d*,115*a*,115*b* stop valve,
116*a*,116*b*,116*c*,116*d* mass flow controller,
119 inert gas, 122 heater, 123, 124 furnace lid,
125,126 heating heater, 134 groove, 135 inlet,
136 outlet, 137 oxidation treatment furnace,
138 tubular member, 139 spring, 140 flange,
141 sword guard form member, 141*a* notch,
142 core tube, 143 joint (flexible tube),
144 castor, 145 purge use gas supply line,
145' inlet, 146 oxidative gas supply line,
151 inert gas inlet, 152*a*,152*b*, inert gas outlet,
160 cover tube, 167, 168 taper (seal part),
170 hole, 140 support member flange,
190 exhaust system, 191 float type flowmeter,
807,808 spiral tube, 809,810 needle valve.

In the following, explanation will be given on an embodiment of the present invention by referring to drawings.

Figure 1:
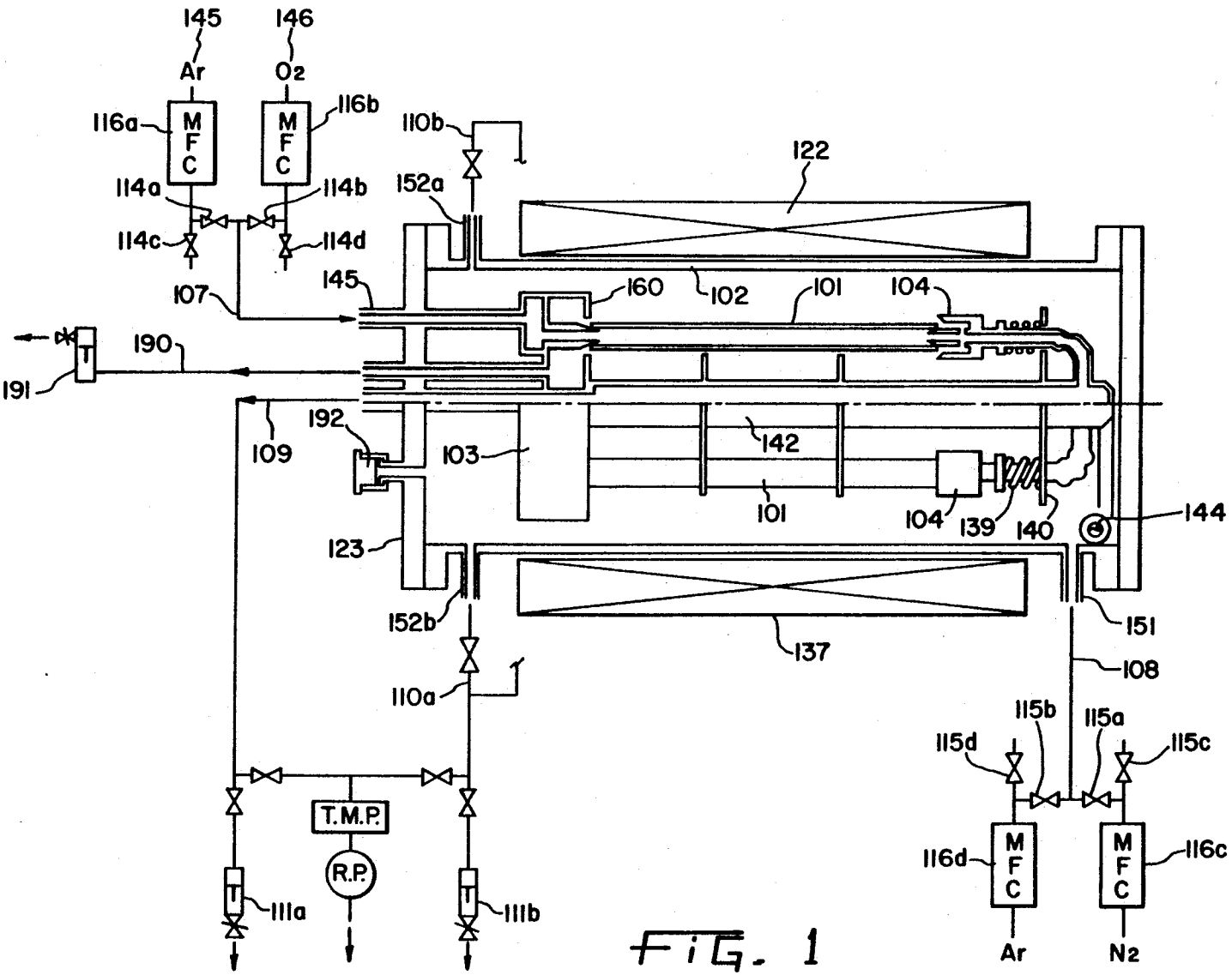

FIG. 1 is an outline diagram of the apparatus for showing an embodiment of the present invention.

In the present example, in a metal tube oxidation treatment apparatus comprising an oxidation treatment furnace 137 having an inert gas inlet 151 for introducing inert gas into the inside of the oxidation treatment furnace 137 and inert gas outlets 152*a*, and 152*b*; holder 103 as the first hollow member for uniformly introducing the gas from the outside of the oxidation treatment furnace 137 into a plural number of stainless steel tubes 101 in said heating furnace 102; and a holder 104 as the second hollow support member for exhausting the gas in the stainless tubes 101 to the outside of the oxidation treatment furnace 137, together with that the stainless steel tube 101 is supported at one end thereof in said oxidation treatment furnace 137; the support part of the stainless steel tube 101 in the holder 103 and the holder 104 are made in a tubular form 138, and on the outer periphery of said tubular member 138, tapers 167 and 168 which gradually decease in external diameter toward the tip are provided, and further, a spring 139 is provided on the holder 104 in such a manner as that the holder 104 can displace to the lengthwise direction of the stainless steel tube 101.

In the following, more detailed explanation will be given on this apparatus.

In FIG. 1, numeral 101 denotes a stainless steel tube as the metal tube to be oxidation treated, and in general, it is an internal surface electrolytically polished tube of SUS 316L material of the diameter of about ¼", ⅜", and ½", and a plural number of constant length pipes of 4 m length are received. It is needless to say that the diameter, length, material may be other than those described above.

Numeral 102 denotes an oxidation furnace chamber, and in the case when heating oxidation treatment has been carried out, it is preferable to make it with stainless steel subjected to the internal surface electrolytic polishing and inactivation treatment of the stainless steel. In the oxidation treatment furnace 137, an inert gas inlet 151 for introducing inert gas into inside and inert gas outlets 152a and 152b are provided. The inert gas inlet 151 is provided at the contrary side (upper right side in the figure) to the entrance and exit side of the stainless steel tube, and the inert gas outlet is preferably provided at the entrance and exit side (upper left side in the figure). When they were provided in such a manner as described above, even when the furnace lid 123 has been opened at the time of receiving the holders 103 and 104, the flow-in of the atmospheric air into the oxidation treatment furnace 137 can be made minimum, since inert gas flows from the contrary side of the entrance and exit side to the entrance and exit side. As a result, the pollution of the internal wall of the oxidation chamber 102 by the atmospheric air can be made minimum, and together with that the purge of the inside of the oxidation furnace chamber 102 can be carried out in a short time, but also, there is the effect of cooling in such a manner that mal-performance due to the burning and the like is not generated in the caster 144.

Numeral 103 denotes a holder as the first support member for supporting this side end of the stainless steel tube 101, and for introducing gas from outside of the oxidation treatment furnace 137 into the stainless steel tube 101, and numeral 104 denotes a holder as the second support member for the interior side end of the stainless steel tube 101, and for exhausting the gas to the outside of the oxidation treatment furnace 137. In the first support member 103 and the second support member 104, the support part is formed as a tubular member 138 for corresponding to the inside shape of the stainless steel tube 101, and further, on the outer periphery of the tubular member 138, there is formed a taper 167. This taper gradually decreases toward the tip, and becomes smaller than the internal diameter of the stainless steel tube 101.

Also, since a spring 139 is mounted on the second support member 104, the second support member 104 is displaceable in correspondence to the stress from outside. In the present example, the second support member flange 140 is put on slidably, and the spring 139 is mounted between the flange 140 and the support member 104. Therefore, in the case when the stainless steel tube is to be supported, one end of the stainless steel tube 101 is inserted into the tapered part 167 of the first support member 103 in such a state that the second support member has been pulled to somewhat interior side (right side on the figure), and after inserting another end of the stainless steel tube 101 into the tapered part 168 of the second support member 104, when the second support member is released, the stainless steel tube 101 can be easily made be supported on the support members 103 and 104.

Also, since the spring 139 such as described above is provided, even when the stainless steel tube 101 has expanded in the oxidation treatment time, deformation due to the heat expansion is not generated, since the second support member 104 displaces in correspondence to expansion.

Further, since a spring 139 is provided on the second support member 104, a force for displacing to the left side on the figure acts on the second support member 104, since a spring 139 is provided on the second support member 104, and moreover, since a taper 167 is formed on the tubular member 138, the tubular member 138 hermetically adheres to the internal surface of the end part of the stainless steel tube 101, and no gap is generated between both members.

Further, a force directed to left side in the figure is applied to the stainless steel tube 101, and the left side of the stainless steel tube 101 is pushed to the tubular member 138 of the first support member 103, and since a taper 167 is formed on this tubular member 138, so that even if when the fluctuation of the left end diameter of the stainless steel tube 101 or the fluctuation of the length is present, gap is not generated between the stainless steel tube 101 and the first support member 103. As a result, the external surface burning and the like is not generated in the stainless steel tube 101.

By the way, in the present example, the support member 103 is fixed to the hollow core tube 142, and the support member 104 is put in the hole of the flange 140 provided on the core tube 142 to be slidable. Further, the gas outlet side end of the support member 104 and the hollow part of the core tube 142 are connected to the flexible hollow joint 143. When the support members 103 and 104 are provided on the core tube 142 in such a manner, whole members form one unit and unification becomes possible, and the reception of the core tubes 142 and the like into the oxidation furnace chamber 102 becomes easy.

Further, a castor 144 is provided at the end part of the core tube 142, and the reception has become easier.

Figure 3:
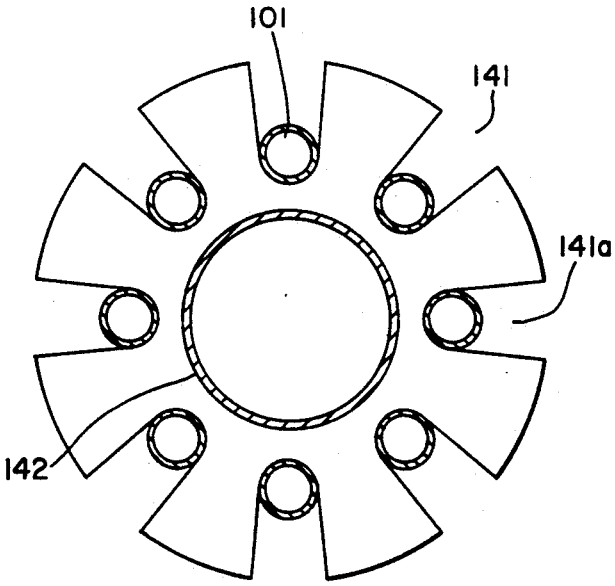
Figure 9:
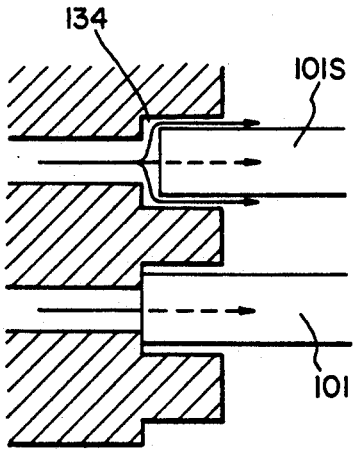
FIGS. 8 and 9 are the apparatus side sectional view for showing the prior examples.
Figure 4A:
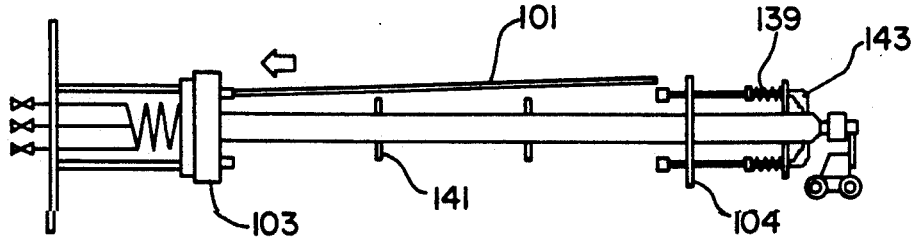
Figure 4B:
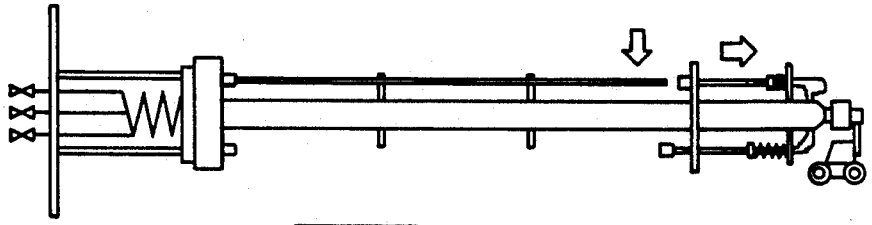
Figure 4C:
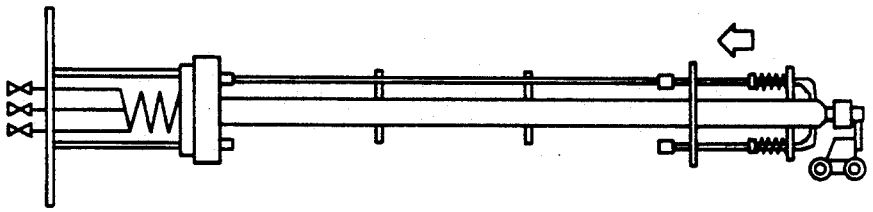
Figure 4D:
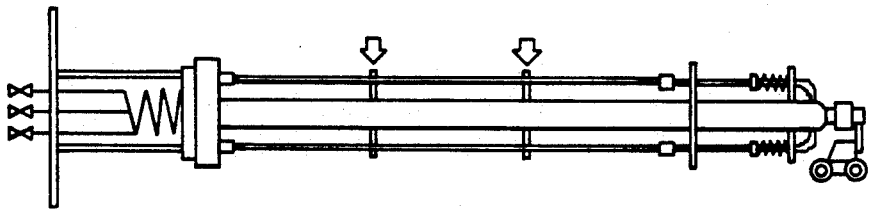
Figure 4E:
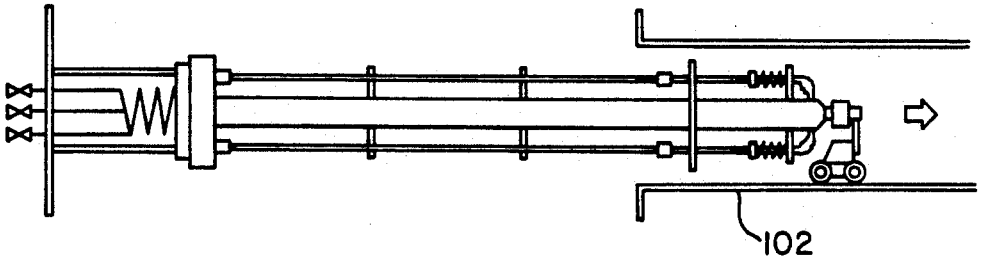
Figure 4F:
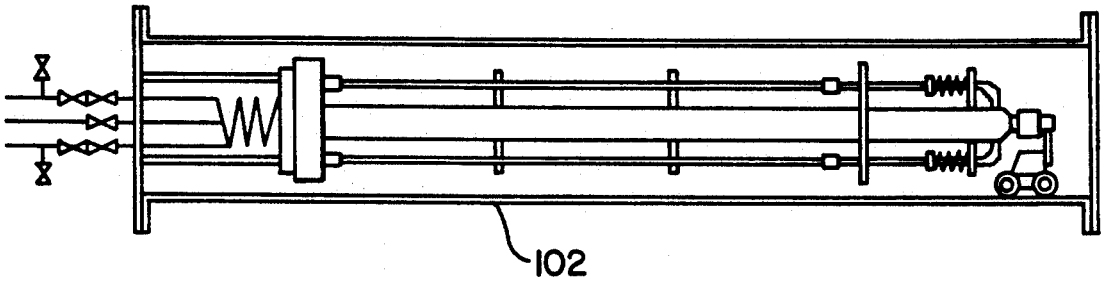

By the way, when a sword guard form member 141 having notches **141*a* of a predetermined dimension such as are shown in FIG. 3 is provided on the core tube 142, the mounting of the tubes becomes easily possible by only inserting the stainless steel tube 101 into the notches 141*a*. By the way, the words "predetermined dimension" means the dimension at which the central axis of the stainless steel tube 101 approximately coincides to the central axis of the tubular member 137 of the support members 103 and 104 on the state of the stainless steel tube 101 is inserted into the notches 141*a* of the sword guard form member 141. Also, it can not only prevent the generation of bending in the central part of the stainless steel tube 101, but also, the position determination of the stainless steel tube 101 can be also easily carried out. By the way, it is preferable that stainless steel is used in this sword guard form member 141**, when such facts are considered as out gas free, particle free, heat expansion, etc.

Further, when at least one hole 170 for communicating to the inside is provided at somewhat interior side from the tapered part of the second support member 104 even if when the oxidative gas intends to diffuse from the tapered part 168 as the seal part of the stainless steel tube 101 and the holder 104 to the oxidation furnace chamber 102, it is recycled through the hole 170 together with the atmosphere gas of the outside of the oxidation treatment furnace 137 and exhausted to the outside, thereby the inactive atmosphere of the oxidation furnace chamber 102 can be preserved and the external surface burning can be prevented.

On the other hand, diffusion of the oxidative gas is generated at the side of the holder 103 in the same manner as in the holder 104 side, and although external surface burning occurs on the stainless steel tube of the holder 103 side, but when a hole such as the same with that in the holder 104 side, the atmosphere gas of the chamber 102 mixes into the stainless steel tube 101 (since the holder 103 side is in the upstream of the oxidative gas), and together with that the gas concentration in the stainless steel tube 101 becomes unable to be controlled arbitrally, and the internal surface of the stainless steel tube 101 quitely receives the effect of the contamination of the out gas from the chamber 102, although its amount is minute. Therefore, in order to solve such maleffect as described above, together with the prevention of the external surface burning, a over tube 160 is formed at the outside of the tubular member 138 in such a manner as it covers the tubular member 138 and forms double tube structure, and it will do that the system 190 for communicating the space formed with the tubular member 138 and the cover tube 160 to the outside of the oxidation treatment furnace 137 is provided other than the system for introducing the gas of the internal surface treatment use (oxidative gas). When the constitution such as described above is adopted, even if the oxidative gas diffuses to the outside via the seal part 167, since the gas is exhausted to the outside of the oxidation treatment furnace 137 via the system 190, the prevention of the external surface burning of the stainless steel tube 101 becomes possible. By the way, it will do that the flow amount of the gas exhausted via the system 190 is controlled by use of a float type flow meter 191.

Numeral 107 denotes the gas introducing line for supplying the purge gas (for example, Ar, $N_2$, etc.) and the oxidation treatment atmosphere gas (for example, $O_2$ and the like). This introducing line 107 is connected to the inlet 145 formed on the support member 103.

On the other hand, numeral 109 denotes the exhaust line for exhausting the gas passed through the gas introducing line 107, the first hollow support member 103, inside of the stainless steel tube 101, the second hollow support member 104, flexible tube 143, and the inside of the hollow core tube 142 to the outside of the oxidation treatment furnace 137, and is connected to the end of the core tube 142.

Numeral 151 denotes an inert gas inlet for supplying the inert gas (for example, Ar) into the oxidation furnace chamber 102 for preventing the pollution due to that the external surface of the stainless steel tube 101 is oxidized, by making the external surface of the stainless steel tube 101 be in inert atmosphere, and is connected to the gas line 108. Numerals **152*a* and 152*b* denote inert gas outlets for exhausting inert gas to outside of the oxidation treatment furnace 137, and are connected to the exhaust lines 110*a* and 110*b***.

In the figures, numerals **111*a* and 111*b* denote flow amount meters (for example, float type flow meter), and 116*a*, 116*b*, 116*c*, and 116*d*** denote mass flow controllers.

The mass flow controllers **116*a* to 116*d* can set and control mass and flow amount to be constant notwithstanding the pressure in the furnace. The flow meters 111*a* and 111*b* have needle valves built-in, and can adjust the pressure in the furnace by the open degree of the needle valve. Thereby, arbitrary pressure difference and flow amount can be set in and out of the stainless steel tube 101**.

Numerals **114*a*, 114*b*, 115*a* and 115*b* denote stop valves. Numeral 122 denotes a heater as the heating member for heating the oxidation furnace chamber 102. In order to obtain the uniformity of the oxidation treatment temperature, the furnace 122 is divided in 6 zones in length-wise direction, and in respective zones, temperature can be set to independent set values. Thermocouples are attached at various positions by passing thermocouple insert use boat 192 in the stainless steel tube 101, and by regulating 6 set values while measuring actual temperature on the stainless steel tube 101, temperature difference on the stainless steel tube 101** is made as little as possible, and uniform treatment becomes possible.

Also, by the above-described effect, sufficient temperature uniformity can be obtained without carrying out preliminary heating. However, pipe is made in a spiral form in the interval between the oxidation use gas inlet 145 and the holder 103, and the length in this interval is made sufficiently long, and when that part is made as a preliminarily heating zone, the oxidative gas is heated almost to the temperature in the furnace and is introduced into the stainless steel tube 101.

Receiving Procedures

In the following, explanation will be given on the function and manipulation procedures of this apparatus by referring to drawings.

FIG. 4 is a state diagram in the case when the units has been taken out of the oxidation furnace chamber 102, and is in the preliminary state before receiving the stainless steel tube. In the inactivation treating technology, since the purity degree of the treating atmosphere thereof gives large influence to the film thickness and film quality of the formed inactivated state film, it is necessary to open the sample in an atmosphere as clean as possible. For this purpose, the state of opening the inside of the oxidation furnace chamber 102 to the atmosphere is made as short as possible for a time, and the pollution of the inside of the oxidation furnace chamber 102 is prevented utmost.

When this pollution by the atmosphere is considered, it is most preferable to take the method that the opened furnace lid to be opened is made be the furnace lid 123 as shown in FIG. 1, and from the furnace lid 124 side, the pug use gas (for example, Ar) is continued to be flown, and the mixing of the atmosphere constituents into the oxidation treatment furnace 137 is prevented.

Figure 2:
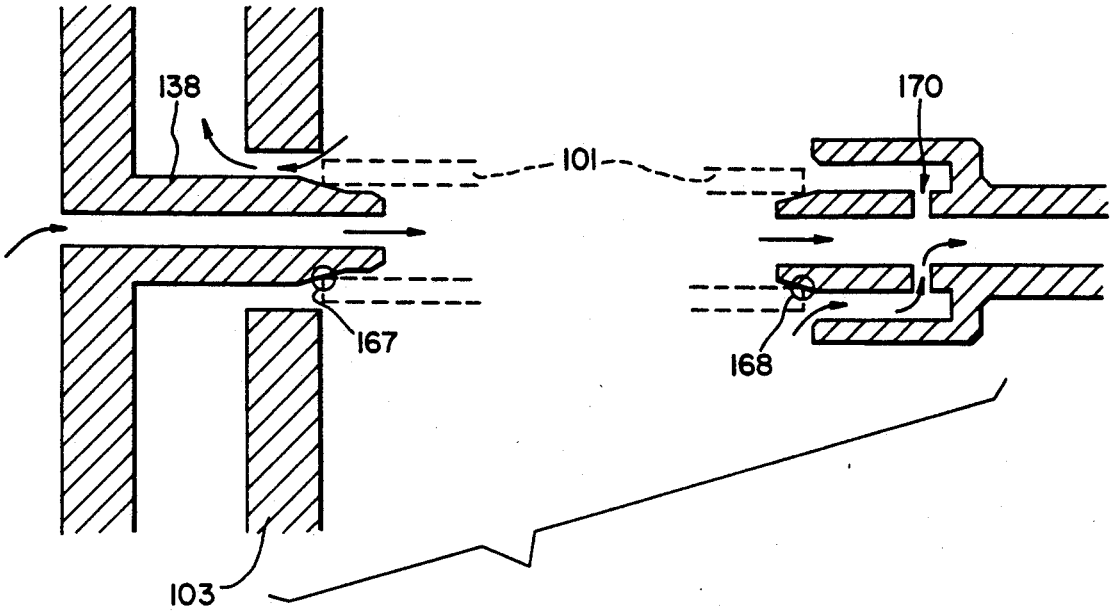

One end of the stainless steel tube 101 is inserted in the taper 167 of the tubular member 138 of the first hollow support member 103 (FIG. 4(*a*)). Next, the stainless steel tube 101 is put in the notch of the sword guard form member 141 (FIG. 2(*b*)). In that case, the second support member 104 is kept in somewhat pulled state.

Subsequently, when the second support member 104 is released, the taper of the tubular member of the second support member 104 is inserted into another end of the stainless steel tube 101. By repeating these procedures, a plural number of stainless steel tubes are made supported on the support member (FIG. 4(*d*)).

Next, the assembly is received into the unit oxidation furnace (FIG. 4(*e*) to 4(*f*)).

FIG. 4(*f*) shows the sate where the unit, in which the stainless steel tube 101 has been supported, is received in the inside of the oxidation furnace chamber 102. In this state, the purge use gas (for example, Ar) is flown in the inside of the stainless steel tube 101 and into the oxidation treatment furnace 137, and the atmosphere in the oxidation treatment furnace 137 and in the stainless steel tube 101 polluted by being exposed to atmosphere is replaced to an inert gas atmosphere. For the removal of the atmosphere constituents, the vacuum purge for repeating the vacuum exhaustion and the gas charging is especially effective. Also, for the removal of adsorbed molecules such as $H_2O$ and $CO_2$ of the oxidation chamber 102, the unit, etc., the "baking" for effecting evacuation and the inert gas purge in heated state of about 120° C. is especially effective. At this time, at first, the reason why the temperature of about 120° C. is selected is that the dense film containing no water as the treatment object of the present apparatus can not be obtained, since when oxidation is started during the time when the oxidative gas such as the residual $O_2$ and the like can not yet be removed, oxidized film containing water grows up.

Next, baking and purge of the oxidation treatment furnace 137 and the stainless steel tube 101 are carried out. The baking is carried out at the same temperature as that of the oxidation temperature (for example, 400° C. to 550° C.) until the water amount in the gas from the outlet becomes less than about 5 ppb.

After finishing the baking and the purge with the purge use gas, oxidation treatment (inactive treatment) is started by adding oxidative gas (for example, $O_2$) to the gas supplied in the inside of the stainless steel tube 101.

In the case of adding this gas, there is the case in which the pollution substance making water as the center mixes in the system. For this case, it has been a large cause that, since the gas to be supplied (for example, $O_2$) has been in stopped state, it was polluted by the released gas making water from the piping internal wall as the center. Therefore, it is desired that the oxidation treatment atmosphere gas and the purge use gas is made as a system which can be always purged, and the pollution in the system at the time of change over this gas is restrained as much as possible.

Figure 5:
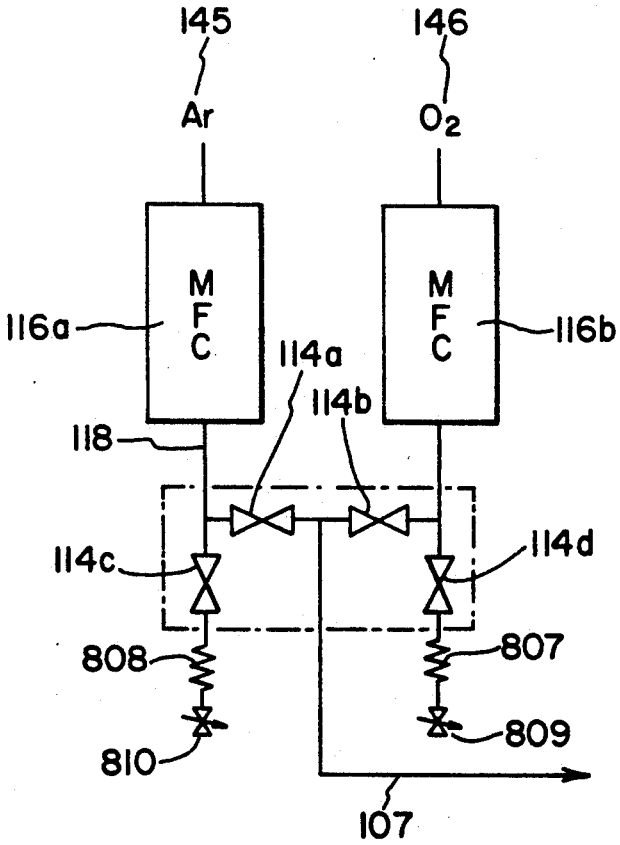
Figure 6:
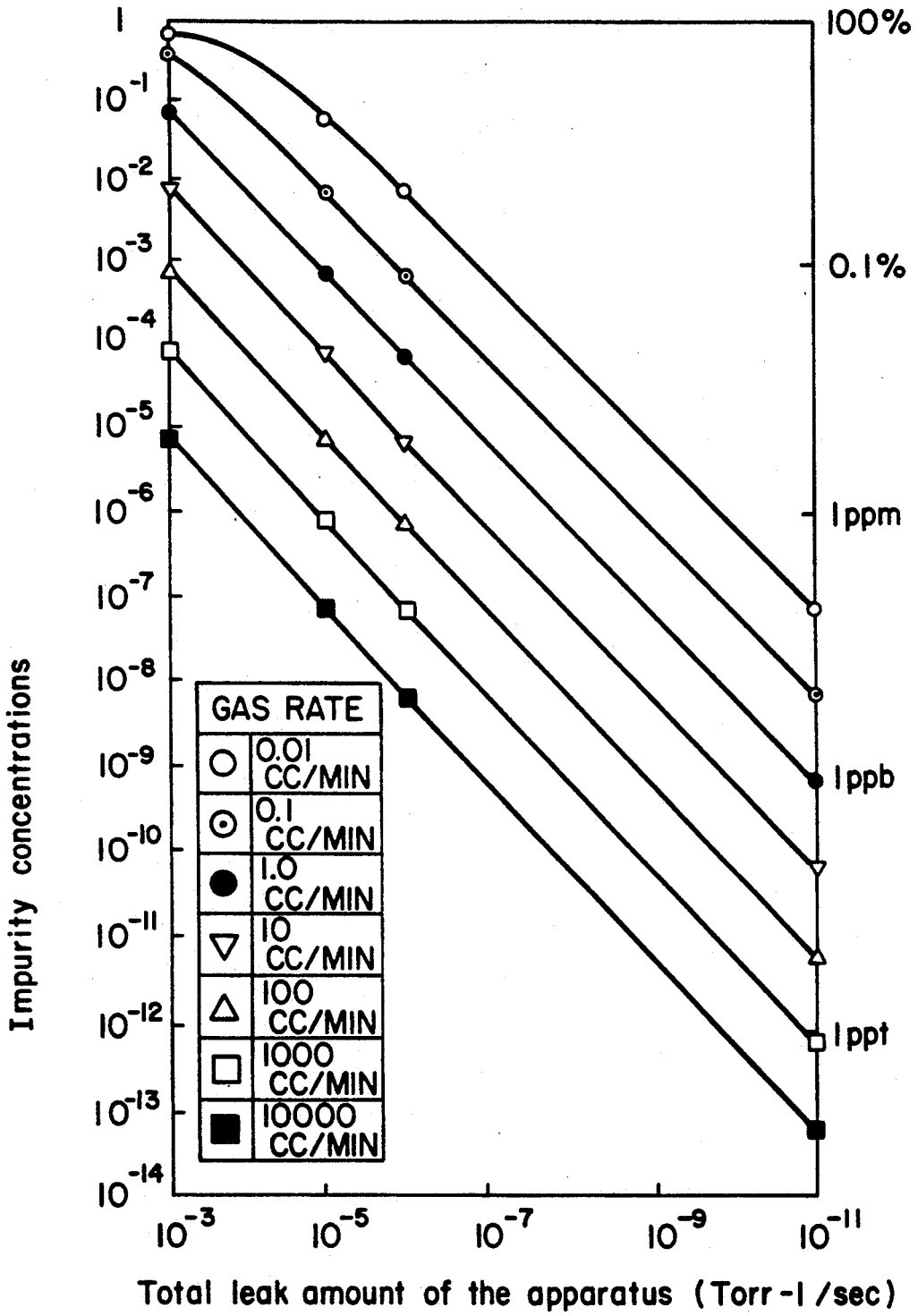
FIG. 6 is a graph for showing the relationship between the leak amount of the apparatus and the impurity amount.
Figure 7:
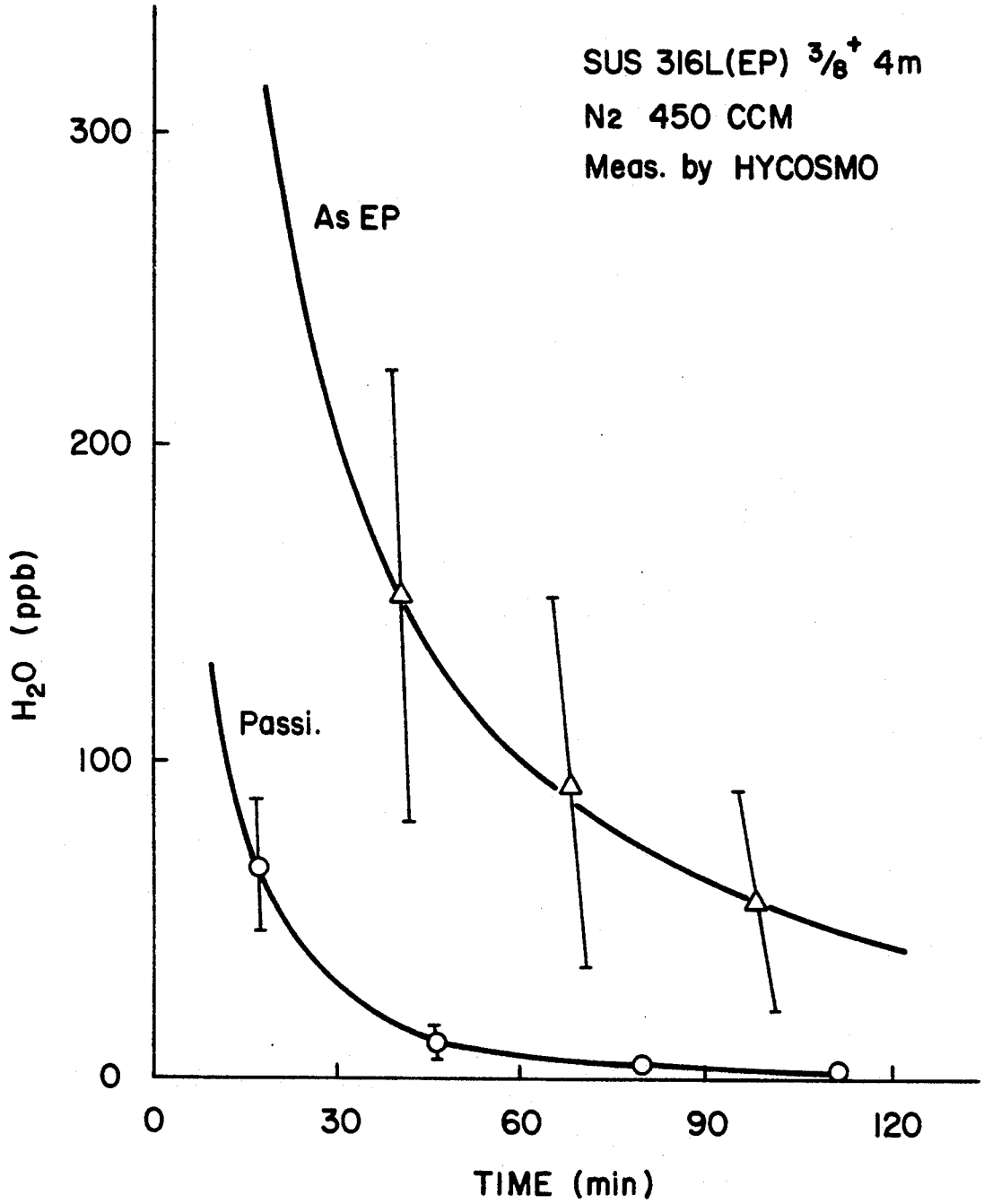
FIG. 7 is a graph for showing the gas exhaustion amount.
Figure 8:
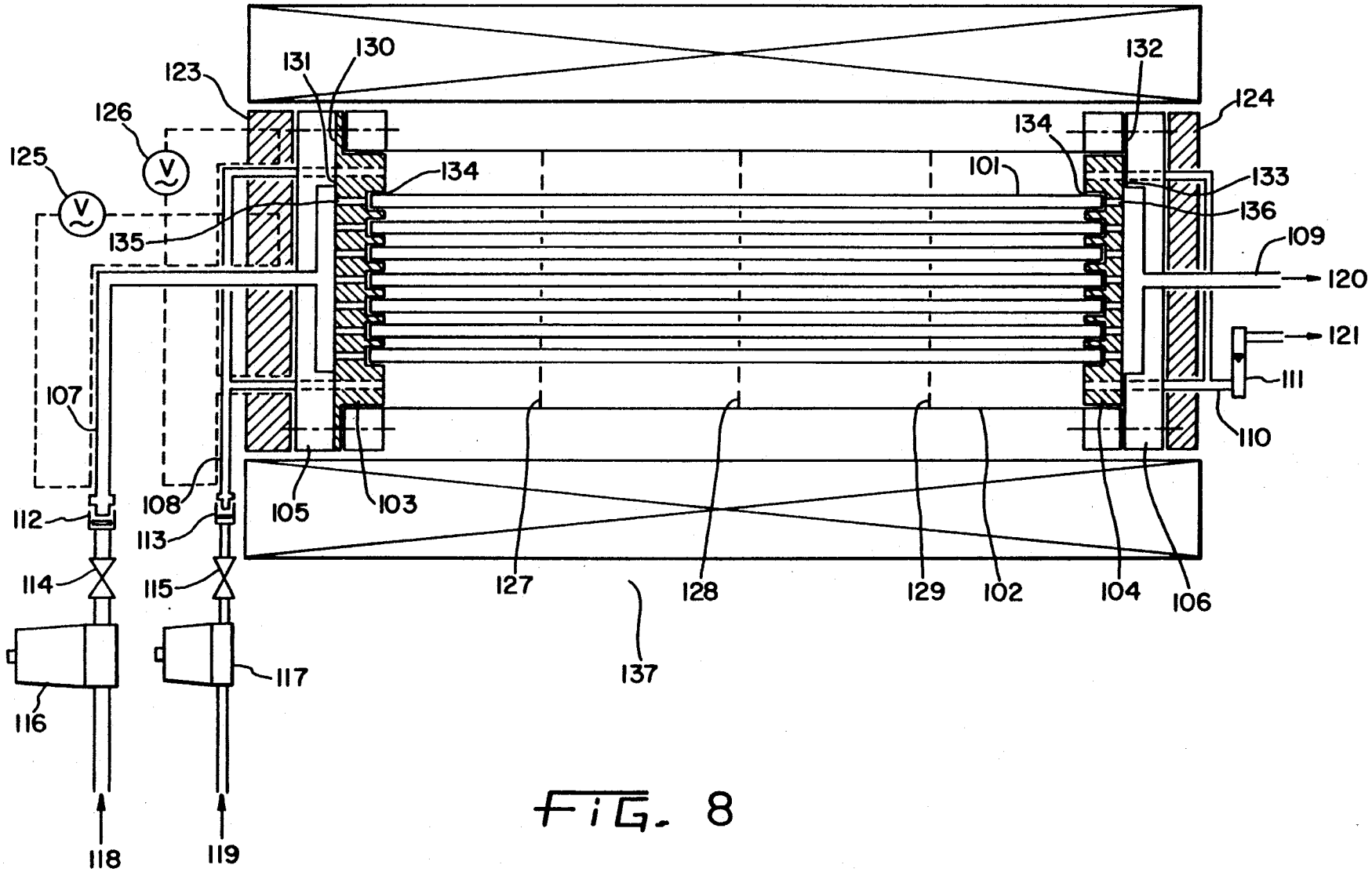

FIG. 5 shows an example of the piping system for preventing the pollution in the system at the time of this gas change over. Numerals 116*a*, 116*b* and 118 respectively correspond to the mass flow controller and the gas supply piping having been shown in FIG. 1. Numeral 146 denotes the supply line of the oxidation treatment atmosphere gas (for example, $O_2$), and 145 denotes the supply line of the purge use gas (for example, Ar). Although the number of pipes for effecting the oxidation treatment is different with the size of the oxidation treatment furnace 137, they are constituted with internal surface electrolysed SUS 316L tubes of about ⅜" or ½". Numerals 114*a* to 114*d* denote stop valves, and make a monoblock valve formed by unification of 4 valves, and in which dead space has been deceased as small as possible. Numerals 807 and 808 denote spiral tubes for preventing the mixing by the reverse diffusion of the atmosphere components from the outlet, and numerals 809 and 810 denote needle valves. Numeral 107 denotes oxidation treatment gas supply line, which is the line for supplying gas to the oxidation treatment furnace 137 shown in FIG. 1.

Next, explanation will be given on the manipulation of the piping system of FIG. 5.

At first, at the time of effecting the purge of the inside of the oxidation furnace, valves 114*b* and 114*c* are closed and 114*a* is opened to supply purge use gas to 107 from 145 via 116*a* and 118. At this time, the valve 114*d* is opened, and the oxidation treatment atmosphere gas has been purged to the exhaust line from 146 via 807 and 809.

After finishing the purge of the inside of the oxidation furnace, nest, the mass flow controller 116*b* is set to about ⅕ of the addition amount, and at the same time of the closing of the valve 114*d*, 114*b* is opened. The facts that the addition amount is set to 1/5 and reversely act 114*d* and 114*b* simultaneously are the counter measure for preventing the over shoot of the addition. It is needless to say that the slow start mode of the mass flow Controller may be used.

By the way, as to the prevention of the over shoot, it is possible to solve by dividing the addition to 3 times and by carrying out it per 5 minutes to 10 minutes.

Also, it is desirable to let the outside of the stainless steel tubes 101 not to be oxidized and polluted by that, before supplying the oxidation treatment atmosphere gas into the oxidation furnace chamber 102, the supply pressure of the oxidation treatment atmosphere gas flowing in the inside of the stainless steel tubes 101, other than the inert gas flowing on the outside of the stainless steel tubes 101 (inside of the oxidation treatment furnace 137) is lowered to about 0.05 to 0.35 $kg/cm^2$ to let the oxidation treatment atmosphere gas not flow out to outside from the support members 103 and 104 to prevent the outside of the stainless steel tubes 101 is oxidized and polluted.

In the present embodiment, when the water amount in the gas exhausted from the outlet has been measured, the value of less than 10 ppb was stably attained during the oxidation treatment. Especially, in the case, when inert gas was flown from the side 151 at the time of reception of the unit, the time for attaining to less than 10 ppb can be shortened, also, in the case when the piping system of FIG. 5 has been used, the value of less than 10 ppb could be continued to preserve even in the time of the change over of the gas.

Further, as to the stainless steel tubes of ⅜" and total length of 4 m obtained by use of the present embodiment, after letting it stand still for about 1 week in a clean room of the relative humidity of 50% at the temperature of 23° C., $N_2$ gas was flown at the flow amount of 0.45 l/min, and the water amount contained in the Ar gas at the outlet was measured with HYCOSMO (low temperature optical dew point meter), it reduced to about 10 ppb after passing the gas, and after 80 minutes, the level of the back ground has become less than 0.12 ppb. That is, the stainless steel tube obtained by use of the present embodiment has an extremely excellent degassing characteristics of the adsorbed gas, and as the result, it shows that the heating oxidation treatment has been carried out in a super high purity atmosphere having the content of water of less than 10 ppb.

As described above, by the present embodiment, super high purity oxidation treatment atmosphere of the water content of less than 10 ppb, which could not be realized in the conventionally generally used metal oxidation treatment apparatus and metal oxidation treatment method could be realized at a low cost and with good production efficiency.

By the way, although in the above-described embodiment, explanation has been given on the apparatus of FIG. 1 for carrying out the inactivation treatment of stainless steel tubes, but it is clearly understood that it is applicable not only to the inactivation treatment of stainless steel tubes, but also applicable to the inactivation treatment of meals of another quality and shape such as, for example, the piping parts such as the pipes, valves, etc. of Ni, Al, etc., highly pure reduced pressure apparatus parts, etc. Also, as the apparatus of the present embodiment, although the one in which the oxidation treatment furnace 137 is a transfers type has been shown, it may be a longitudinal type.

According to the present invention, an inactivated state film of good quality can be formed on the internal surface of stainless steel tubes, and the external surface burning is prevented and recleaning is not necessary, and cost down and productivity improvement have become possible at the same time.

What is claimed is:

1. An oxidation treatment apparatus for treating a metal tube, comprising:

an oxidation treatment furnace having an inert gas inlet for introducing inert gas into said furnace, and an inert gas outlet for exhausting inert gas from aid furnace;

a first hollow support member for introducing gas from the outside of said furnace into the metal tube, said first hollow support member including a first tubular member for supporting one end of the metal tube, said first tubular member having a generally frustoconical shape; and a second hollow support member for exhausting gas from the inside of the tube to the outside of said furnace, said second hollow support member including a second tubular member for supporting an opposite end of the metal tube, said second tubular member having a generally frustoconical shape;

said first hollow support member including a cover tube for covering said first tubular member, said cover tube and said first tubular member defining a space therebetween which is in fluid communication with an exterior of said furnace.

2. The oxidation treatment apparatus of claim 1, wherein said second tubular member has a generally frustoconical shape, said second tubular member including at least one hole disposed therein.

3. The oxidation treatment apparatus of claim 1, further comprising a flexible hollow joint, a hollow core tube connected to one end of said flexible hollow joint, and a flange connected to another end of said flexible hollow joint, said second hollow support member disposed adjacent aid flange and including an outlet which is in fluid communication with said hollow core tube.

4. The oxidation treatment apparatus of claim 3, further comprising a sword guard attached to the outer periphery of said hollow core tube, said sword guard having a plurality of notches disposed therein.

5. The oxidation treatment apparatus of claim 3, further comprising a castor connected to said hollow core tube.

6. An oxidation treatment apparatus for treating a metal tube, comprising:

an oxidation treatment furnace having an inert gas inlet for introducing inert gas into said furnace, and an inert gas outlet for exhausting inert gas from said furnace;

a first hollow support member for introducing gas from the outside of said furnace into the metal tube, said first hollow support member including a first tubular member for supporting one end of the metal tube, said first tubular member having a generally frustoconical shape;

a second hollow support member for exhausting gas from the inside of the tube to the outside of said furnace, said second hollow support member including a second tubular member for supporting an opposite end of the metal tube, said second tubular member having a generally frustoconical shape, said second tubular member including at least one hole disposed therein.

7. The oxidation treatment apparatus of claim 6, wherein said first hollow support member includes a cover tube for covering said first tubular member, said cover tube and said first tubular member defining a space therebetween which is in fluid communication with an exterior of said furnace.

8. The oxidation treatment apparatus of claim 6, further comprising a flexible hollow joint, a hollow core tube connected to one end of said flexible hollow joint, and a flange connected to another end of said flexible hollow joint, said second hollow support member disposed adjacent said flange and including an outlet which is in fluid communication with said hollow core tube.

9. The oxidation treatment apparatus of claim 8, further comprising a sword guard attached to the outer periphery of said hollow core tube, said sword guard having a plurality of notches disposed therein.

10. The oxidation treatment apparatus of claim 8, further comprising a castor connected to said hollow cover tube.

* * * * *